US008424540B2

(12) United States Patent
Olegario et al.

(10) Patent No.: US 8,424,540 B2
(45) Date of Patent: Apr. 23, 2013

(54) SMOKING ARTICLE WITH VALVED RESTRICTOR

(75) Inventors: Raquel Olegario, Richmond, VA (US); San Li, Midlothian, VA (US); Roland W. Dwyer, Richmond, VA (US); Mike Braunshteyn, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 542 days.

(21) Appl. No.: 12/576,922

(22) Filed: Oct. 9, 2009

(65) Prior Publication Data

US 2011/0083675 A1 Apr. 14, 2011

(51) Int. Cl.
*A24D 3/06* (2006.01)

(52) U.S. Cl.
USPC ..... 131/339; 131/331; 131/332; 131/344

(58) Field of Classification Search ..... None
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |
| 2,954,786 | A | 10/1960 | Lebert |
| 3,098,492 | A | 7/1963 | Wurzburg et al. |
| 3,234,949 | A | 2/1966 | White et al. |
| 3,236,244 | A | 2/1966 | Irby, Jr. et al. |
| 3,255,760 | A | 6/1966 | Selke |
| 3,283,762 | A | 11/1966 | Kissel |
| 3,292,635 | A | 12/1966 | Kolodny |
| 3,318,312 | A | 5/1967 | Curtis, Jr. |
| 3,323,525 | A | 6/1967 | Miller |
| 3,356,094 | A | 12/1967 | Ellis et al. |
| 3,389,705 | A | 6/1968 | Levavi |
| 3,395,713 | A | 8/1968 | Ent-Keller |
| 3,441,028 | A | 4/1969 | Wall |

(Continued)

FOREIGN PATENT DOCUMENTS

| | | | |
|---|---|---|---|
| BE | 679657 | A | 10/1966 |
| BE | 1000454 | A4 | 12/1988 |

(Continued)

OTHER PUBLICATIONS

International Search Report mailed Sep. 13, 2010 for International Application No. PCT/EP2010/003016.

(Continued)

*Primary Examiner* — Michael J Felton
(74) *Attorney, Agent, or Firm* — Buchanan Ingersoll & Rooney PC

(57) ABSTRACT

A smoking article filter includes a valved flow restrictor and a cavity downstream of the flow restrictor. The flow restrictor includes an orifice or flow channel for directing smoke into the cavity. The filter is attached to the tobacco rod with tipping paper and includes an air-admissible ventilating zone at a location downstream of the restrictor. The valved restrictor can be used to isolate a sorbent bearing component of the filter from a flavor bearing component.

11 Claims, 4 Drawing Sheets

U.S. PATENT DOCUMENTS 3,457,927 A 7/1969 Siragusa
3,496,945 A 2/1970 Tomkin
3,504,677 A 4/1970 Doppelt
3,581,748 A 6/1971 Cameron
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A 10/1986 Keith
4,620,553 A 11/1986 Bale et al.
4,622,982 A 11/1986 Gaisch et al.
4,637,409 A 1/1987 Berger
4,638,820 A 1/1987 Roberts et al.
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh et al.
4,867,182 A 9/1989 Roberts et al.
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1 12/2004 Dube et al.
2005/0066981 A1 3/2005 Crooks et al.
2006/0201524 A1 9/2006 Zhang et al.
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0035162 A1 2/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216850 A1 9/2008 Li et al.
2008/0216851 A1 9/2008 Olegario et al.
2008/0216853 A1 9/2008 Li et al.
2010/0288293 A1 11/2010 Slasli et al.

FOREIGN PATENT DOCUMENTS

DE 3439861 A1 5/1985
EP 0 054 705 A1 6/1982
EP 0077123 A2 4/1983
EP 0101840 A 3/1984
EP 0212879 A1 3/1987
EP 0 327 655 A1 8/1989
EP 0364256 A1 4/1990
EP 0471581 A1 2/1992
EP 0482872 A1 4/1992

| | | | |
|---|---|---|---|
| EP | 0568107 | A | 11/1993 |
| EP | 0481596 | B1 | 1/1994 |
| FR | 2481581 | | 11/1981 |
| FR | 2873899 | A | 2/2006 |
| GB | 1058342 | A | 2/1967 |
| GB | 1228747 | | 4/1971 |
| GB | 1236344 | A | 6/1971 |
| GB | 1245518 | A | 9/1971 |
| GB | 1256154 | | 12/1971 |
| GB | 1 397 936 | | 6/1975 |
| GB | 1428018 | | 3/1976 |
| GB | 2100573 | A | 1/1983 |
| GB | 2149287 | A | 6/1985 |
| GB | 2 175 190 | A | 11/1986 |
| GB | 2177890 | A | 2/1987 |
| NZ | 19697 | | 11/1983 |
| NZ | 216244 | | 9/1989 |
| WO | WO 90/09741 | A | 9/1990 |
| WO | WO 99/26495 | A | 6/1999 |
| WO | WO 00/00047 | | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO 2007/093757 | A1 | 8/2007 |
| WO | WO 2007/110650 | A1 | 10/2007 |
| WO | WO 2008/110935 | A2 | 9/2008 |

OTHER PUBLICATIONS

International Search Report mailed Feb. 2, 2011 for International Application No. PCT/EP2010/006106.
U.S. Appl. No. 12/782,443, filed May 18, 2010.
International Preliminary Report on Patentability mailed Apr. 11, 2012 for PCT/EP2010/006106.
Written Opinion dated Aug. 5, 2004 for International Application No. PCT/US04/04530.
International Search Report dated Aug. 5, 2004 for PCT/US04/04530.
International Search Report dated Oct. 19, 2007 for International Application No. PCT/IB2006/004202.
Written Opinion dated Oct. 19, 2007 for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Mar. 17, 2008 for PCT/IB2006/004209.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 11, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.
International Search Report and Written Opinion dated Jan. 24, 2008 for PCT/IB2007/002910.
International Search Report and Written Opinion mailed Jan. 27, 2009 for PCT/IB2008/001348.
International Preliminary Report on Patentability issued Sep. 15, 2009 for PCT/IB2008/001348.
New Zealand Examination Report cited in New Zealand Patent Application No. 573730, Jul. 8, 2010.
International Search Report and Written Opinion dated Oct. 7, 2008 for PCT/IB2008/001382.
International Preliminary Report on Patentability issued Sep. 15, 2009 for PCT/IB2008/001382.
International Preliminary Report on Patentability issued Feb. 10, 2009 for PCT/IB2007/003165.
New Zealand Examination Report cited in New Zealand Patent Application No. 571453, Mar. 10, 2010.
International Search Report and Written Opinion dated Mar. 26, 2008 for PCT/IB2007/003165.

SMOKING ARTICLE WITH VALVED RESTRICTOR

BACKGROUND

Heretofore, cigarettes with high levels of ventilation have usually had unacceptably low levels of resistance to draw (RTD) unless some counter measure was in place to make-up the shortfall in RTD. In the past, high density cellulose acetate filter segments were used to address the shortfall. However such filtered segments tended to reduce tar delivery (FTC), with little or no effect upon gas phase components of mainstream tobacco smoke, such as carbon monoxide (CO) and nitrogen oxide (NO). This solution tended to worsen the CO to tar (FTC) ratios in lower delivery (FTC tar) cigarettes.

Ventilation has a desirable attribute in that, when operating alone, it will reduce both the particulate phase and the gas phase of mainstream smoke. Highly ventilated cigarettes however have drawbacks in RTD as previously discussed.

DETAILED DESCRIPTION OF PREFERRED EMBODIMENTS

Presently disclosed embodiments provide the benefit of a highly ventilated smoking article with desired amounts of resistance to draw.

Figure 1A:
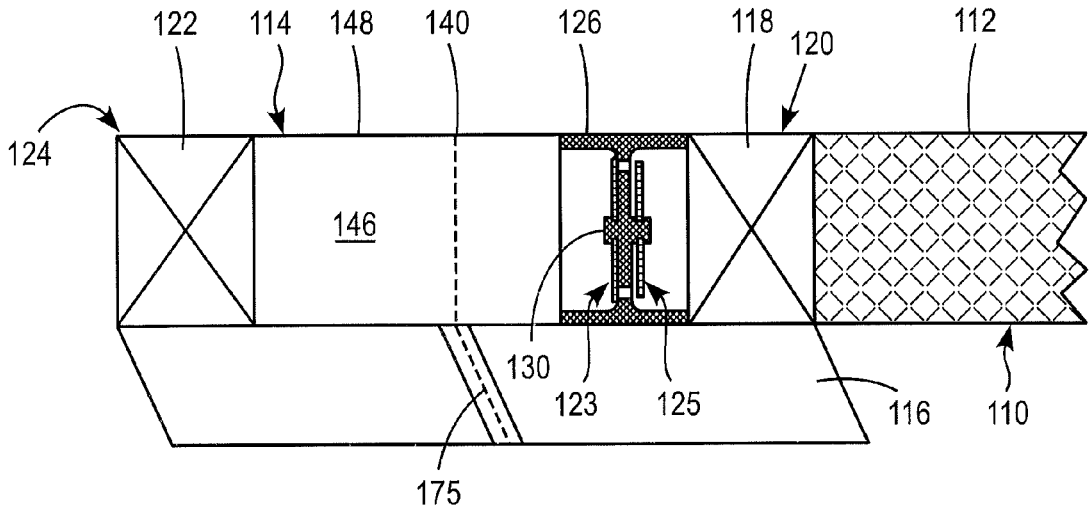
FIG. 1A is an illustration of a smoking article including a filter having a valved flow restriction device.

Referring now to FIG. 1A, a preferred embodiment provides a smoking article 110 comprising a tobacco rod 112 and a filter 114 connected with the tobacco rod 112 by a tipping paper 116. Preferably, the filter 114 comprises a first filter segment 118 at an upstream end portion 120 of the filter 114, a mouthpiece filter segment 122 at downstream end portion 124 of the filter 114, and a valved flow restricting filter segment 126 situated between the first and mouthpiece filter segments 118 and 122. The valved flow restricting segment 126 preferably includes one or more flow restriction passages 130 therethrough. In this embodiment, filter segments 118 and 122 are low particulate efficiency filter segments preferably constructed from less densely packed, large diameter fiber cellulose acetate tow of approximately 5.0 denier to approximately 15.0 denier per filament (dpf), such as 8 dpf, and approximately 10,000 to approximately 50,000 total denier (td), such as 35,000 td. Also in this embodiment, a relatively short valved flow restricting filter segment 126 (hereinafter, restrictor disc) is adjacent the first upstream filter plug 118 of a length of approximately 3 to 10 mm, more preferably approximately 3 mm to 7 mm in length. In this embodiment, a central cavity 146 within the filter 114 is defined at least in part by a tubular filter segment 148, such as a cylindrical cellulosic tube and by the spaced apart relation of the mouthpiece filter 122 and the restrictor disc 126. A ventilation zone 140 is provided at a location along the cavity 146, which location is preferably downstream of the restrictor segment 126 and spaced apart from the mouthpiece segment 122. The tubular filter segment 148 is preferably constructed from a relatively heavy filter plug, paper or other material such as cellulose acetate.

In this embodiment, the ventilation zone 140 comprises a plurality of ventilation holes which extend through the tipping paper 116 and optionally through the tubular filter segment 148. This arrangement facilitates the use of online laser perforation techniques to provide ventilation holes during the manufacture of the smoking article 110. Other techniques may be used to create the ventilation zone 140 such as using off-line, pre-perforated tipping paper, mechanical perforation, electrostatic perforation and other techniques.

Figure 1B:
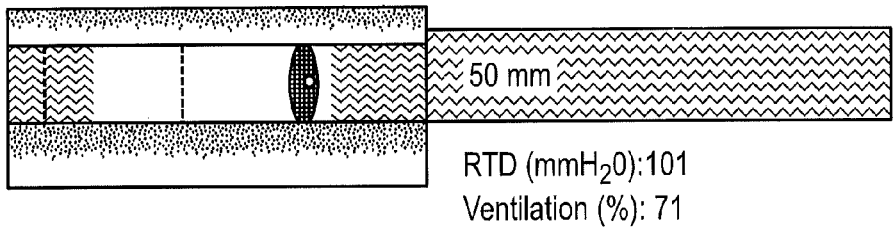
FIGS. 1B-1D are representations of experimentally measured values of RTD and ventilation of an unlit smoking article constructed with downstream ventilation.
Figure 1C:
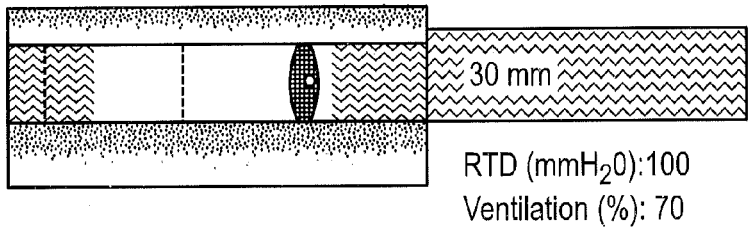
Figure 1D:
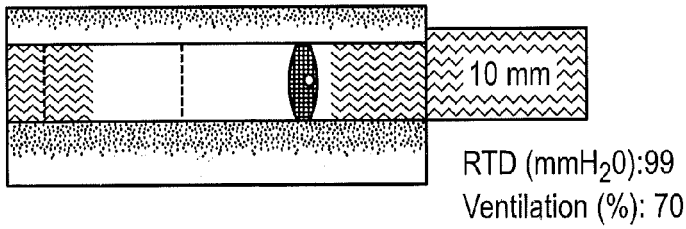

Referring now to FIGS. 1B-1D and Table 1 below, for unlit cigarettes having downstream ventilation and an upstream restriction, a desired degree of ventilation (approximately 70%) is maintained throughout the puff count.

Figure 1E:
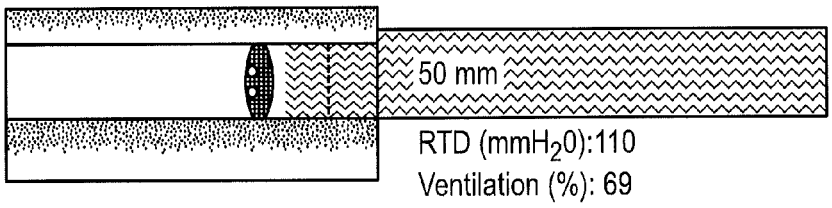
FIGS. 1E-1G are representations of experimentally measured values of RTD and ventilation of an unlit smoking article constructed with upstream ventilation.
Figure 1F:
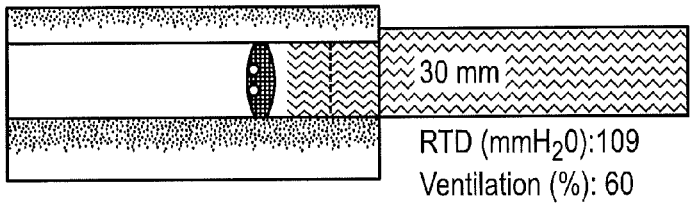
Figure 1G:
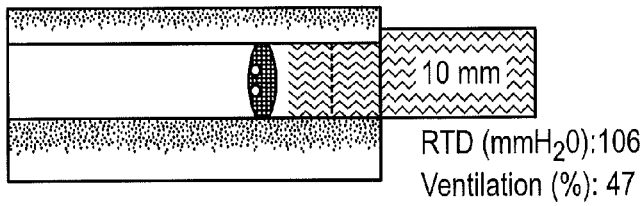

Referring now to FIGS. 1E-1G, in contrast, when ventilation holes are placed upstream of the restriction, ventilation tends to drop as one progresses through the puff count.

TABLE 1

| Remainder of Tobacco Rod | Restrictor Upstream of Ventilation | Restrictor Downstream of Ventilation |
|---|---|---|
| 50 mm | RTD (mm $H_2O$): 101<br>Ventilation (%): 71 | RTD (mm $H_2O$): 110<br>Ventilation (%): 69 |
| 30 mm | RTD (mm $H_2O$): 100<br>Ventilation (%): 70 | RTD (mm $H_2O$): 109<br>Ventilation (%): 60 |
| 10 mm | RTD (mm $H_2O$): 99<br>Ventilation (%): 70 | RTD (mm $H_2O$): 106<br>Ventilation (%): 47 |

A cigarette having an upstream restrictor 126 with downstream ventilation 140, as described herein, can provide various effects during smoking. For example, as flow rate of a puff increases, pressure drop at the restrictor increases more rapidly compared to a conventional CA filter. Thus, the restrictor works as a limiter on the extent to which a smoker may attempt to draw hard on a smoking article during the puff count. In addition, having the ventilation zone 140 downstream of the restrictor orifice 130 decouples their respective functionalities (ventilation levels and RTD) such that a cigarette designer may adjust RTD by changing the size of the restrictor orifice 130 essentially without impacting ventilation levels already established at zone 140 and visa versa.

The valved flow restriction segment 126 may comprise an impermeable partition (transverse wall) having one or more orifices therein, that establishes the flow restriction 130, with the restriction specifically in the form of an orifice of reduced diameter. If desired, the partition can be perpendicular to the longitudinal axis of the smoking article or frustoconical and convergent either into or away from the direction of flow of mainstream smoke passing therethrough. Furthermore, the restrictor segment 126 may be configured to provide end to end symmetry. A filter component having end to end symmetry facilitates high speed filter rod making in that the component works the same whether or not the rod making machine orients one end of the component first or reverses it.

A restrictor segment 126 having end to end symmetry has tubular body portions of equal length on opposite sides of a transverse wall (partition). By such arrangement manufacture of the filter is facilitated by the end to end symmetry of the restrictor disc 126.

Optionally, a zone of ventilation may be located upstream of the flow restriction 130 in addition to ventilation zone 140 as provided above.

Manufacture of the smoking articles 110 in accordance with the present disclosure may be facilitated with the use of pre-perforated tipping paper.

Preferably the flow restriction 130 is sized to contribute sufficient pressure drop such that the smoking article 110 presents a resistance to draw of at least 40 mm water or greater, preferably in the range of 50-100 mm water. Preferably, the partition (transverse wall) has a diameter of approximately 7.0 to 8.0 mm and more preferably approximately 7.4 to 7.8 mm wherein the partition preferably has one or optionally, at least one orifice of a diameter of about 0.5 mm to about 1.0 mm and more preferably about 0.5 to 0.7 mm. Since the pressure drop of the restrictor component depends on the open area, multiple orifices can also be used. For example, in one embodiment there are two orifices in the partition of 0.5 mm diameter each.

The restrictor 126 may be constructed of paper, a plastic, polymer or a metal and more preferably made of a paper product or a biodegradable plastic/polymer or other suitable material having biodegradability properties. However, in the case of plastic being used, the restrictor 126 is small and the non-biodegradable content of the filter is minimized.

Preferably, the flow restriction 130 and the mouthpiece filter 122 are spaced apart sufficiently to reduce impaction of particulate smoke components upon the upstream face of the mouthpiece filter segment 122. Preferably, the flow restriction 126 is spaced approximately 4 mm to 20 mm from the mouthpiece filter 122, more preferably approximately 6 to 10 mm.

It is to be appreciated that the filter preferably may be constructed from simple combining techniques typically used in the industry for manufacturing cigarettes at high speeds. Additionally each embodiment includes tubular support about the cavity 146 so as to provide desired firmness throughout length of the filter 114. Furthermore, the embodiments provide the necessary amount of resistance to draw while maintaining the desired degree of high ventilation throughout the puff count. The latter attribute is achieved by placement of the ventilation zone 140 downstream of the flow restriction 136. Furthermore, placing the ventilation along cavity 146 assures mixing of air drawn into the filter 114 through the ventilation zone 140 with mainstream smoke drawn from the tobacco rod 112. In one tested embodiment, uniform stain patterns appeared at the buccal end of the mouthpiece filter 122, which is indicative of good mixing.

During smoking of a cigarette constructed in accordance with the present disclosure, a consistent degree of ventilation (e.g., 50 to 90%, preferably about 70%) is preferably maintained throughout the puff count.

In contrast, when ventilation holes are placed upstream of the flow restriction segment 126, ventilation tends to drop as smoking progresses through the puff count.

In an embodiment, the filter comprises a tubular segment 148 of cellulose acetate tow (sometimes referred to as a hollow acetate tube or HAT) and a restrictor insert 126 inserted into an upstream end thereof. Preferably, the restrictor insert 126 includes a transverse disc shaped wall with one or more openings 130 therein having a length of about 3 mm to about 10 mm, more preferably about 3 mm to about 7 mm in length.

In an embodiment, a central cavity 146 within the filter 114 is defined at least in part by the tubular segment 148. Preferably, a ventilation zone 140 communicates with the cavity 146 at a location downstream of the restrictor insert 126. The tubular segment 148 is preferably constructed from a hollow acetate tube (HAT) and is air permeable so that ventilation air may be drawn through ventilation holes 175 into the cavity 146 during a puff. Other low density, low filtration materials can also be used to construct the tubular segment 148.

In a preferred embodiment, the ventilation zone 140 comprises a plurality of ventilation holes 175 arranged in one or more circumferential rows, which extend through the tipping paper 116 and optionally/partially into or through the tubular segment 148. This arrangement facilitates the use of online laser perforation techniques to provide ventilation holes 175 during the manufacture of the smoking article 110. Other techniques may be used to create the ventilation zone 140 such as using off-line, pre-perforated tipping paper, mechanical perforation, electrostatic perforation and other techniques.

The ventilation holes 175 in the tipping paper 116 allow atmospheric air to be drawn into the ventilation zone 140, through the tubular segment 148, and into the cavity 146. When a hollow acetate tube forms at least part of the tubular segment 148, perforations need not be made in the tubular filter segment 148 because the material is air permeable.

In a preferred embodiment, the ventilation zone 140 and the tubular filter segment 148 achieve a ventilation level of the smoking article of at least about 25% and more preferably at least about 50% to about 90%.

For ease of manufacturing on high speed filter rod making equipment, the outer diameter of the restrictor segment 126 is less than that of the original diameter of the tubular segment 148 prior to filter rod making operations. Preferably, the diameter of the restrictor segment 126 is smaller than the pre-determined diameter of the cigarette to be made. For example, for a cigarette having a circumference of 24.1 mm, the circumference of the restrictor segment 126 is preferably 1 to 10% smaller, e.g., approximately 23.9 mm or less in the example. As is typically done in established filter rod making techniques, the original diameter or the HAT segment 148 is slightly oversized so that it may be uniformly compressed into the desired diameter (e.g. 24.1 mm), and held in place by the plug wrap during filter making operations. Because the restrictor segment 126 is of lesser diameter, it passes through the garniture of a filter rod making machine without snagging.

Preferably, the restrictor segment 126 is a single piece that is injection molded. The restrictor segment 126 is preferably made of a plastic, metal, cellulosic material, and/or composite of a plastic and starch. Suitable plastics include, without limitation, polypropylene, polyethylene, polystyrene, nylon, polysulfone, polyester, polyurethane, and combinations thereof.

As seen in FIG. 1A the restrictor segment 126 includes a valve element 123 and optionally an upstream a valve element 125 in cooperative relation with two restrictor orifices 130.

Valve element 123 moves from a first closed position where it closes off the restrictor orifice 130 to a second open position upon draw on the smoking article during a puff to open the orifices 130.

The optional valve element 125 is movable from a first open position at which the orifices 130 are open to a second closed position at which the orifices 130 are partially or fully closed. For example, valve element 125 can include a flexible element that in its static position is spaced away from the restrictor orifices 130. At exacerbated drawing volume, the valve element 125 is drawn to a position which at least partially closes off the restrictor orifices 130, so as to check further draw and limit further delivery of mainstream smoke.

The valve element 123,125 can have various constructions. For example, the valve can include a bendable flap (diaphragm), which is deflected when smoke is drawn downstream through the filter. In another example, the valve can include a movable member such as an axially sliding disk which when closed overlies one or more orifices 130 in the transverse wall of the restrictor insert. The disk can be attached to a shaft which extends through a bore in the transverse wall containing the orifice 130. With such arrangement, when mainstream smoke is drawn through the orifice 130 the downstream valve 123 opens and at high levels of draw valve 125 limits or shuts off flow of mainstream smoke through the orifice 130.

Figure 2:
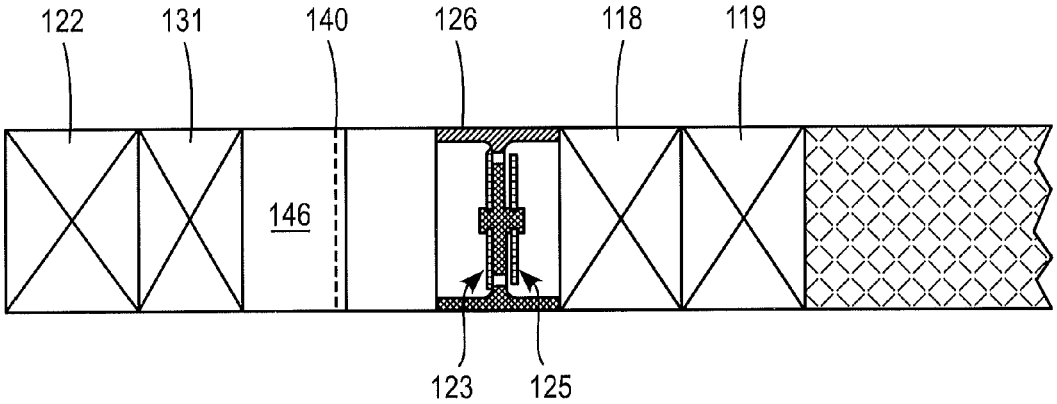
FIG. 2 is an illustration of a smoking article including a filter having a valved flow restriction device.

Referring now also to FIG. 2, another embodiment is constructed in accordance with the layout of the embodiment described in reference to FIG. 1, but with the addition of a flavor (e.g., menthol) bearing segment 131 just upstream of the mouthpiece filter segment 122, a valve arrangement constructed in the same manner as the valve arrangement described in FIG. 1A, and a sorbent bearing segment 119 upstream of the valve arrangement. Advantageously, the valve element 123 in its static position closes the restrictor orifice 130, which impedes migration of the flavorant in filter segment 131 to the adsorbent (e.g., activated carbon) in filter segment 119 throughout shelf-life of the product.

Figure 3A:
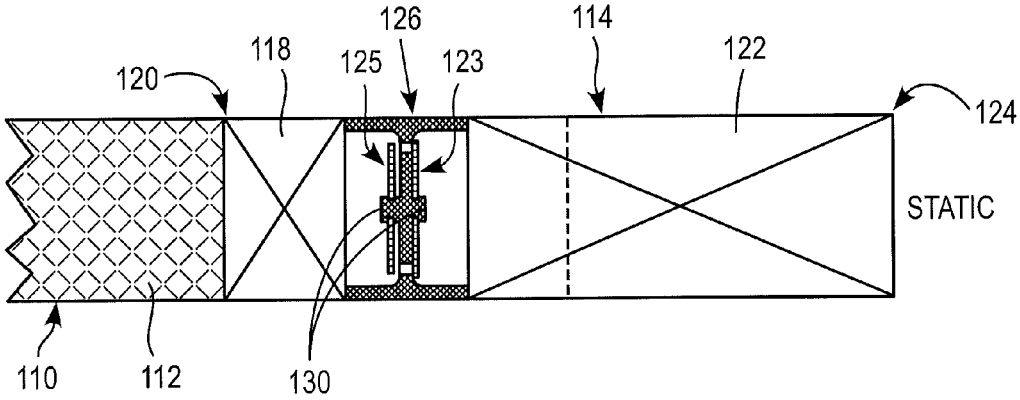
FIG. 3A is an illustration of another embodiment of a valved flow restriction device.
Figure 3B:
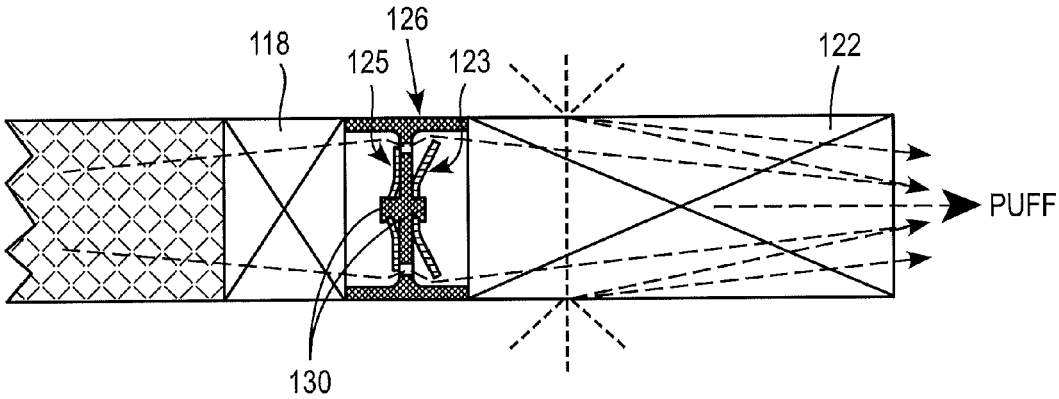
FIG. 3B is an illustration of the valved flow restriction device of 3A during a puff.

Referring now to FIG. 3A, another embodiment of the valved flow restrictor segment 126 is shown under normal or mild puffing conditions. The upstream valve 125 and downstream valve 123 remain undeformed to prevent smoke from passing through the orifice 130. As shown in FIG. 3B, under harsh puffing conditions, the upstream valve 125 and downstream valve 123 are deformed to cover part of the orifice 130 to allow only a pre-determined amount of smoke to pass through the orifice 130. Any additional air will go through the ventilation holes in the tipping paper.

Figure 4A:
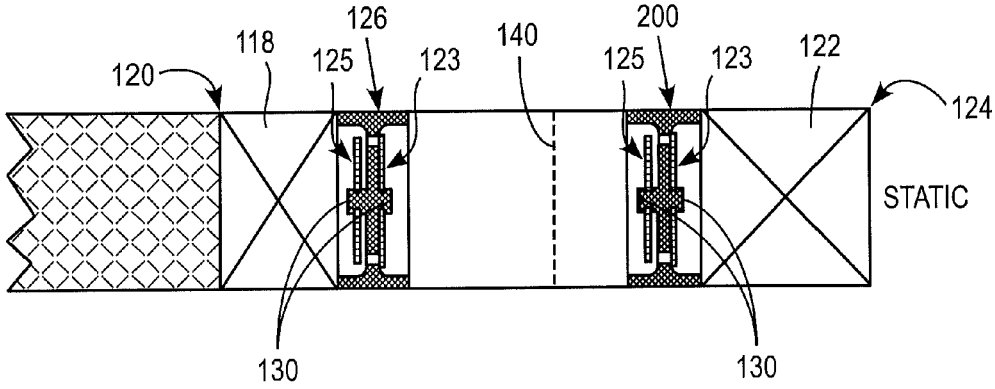
FIG. 4A is an illustration of another embodiment of a valved flow restriction device.
Figure 4B:
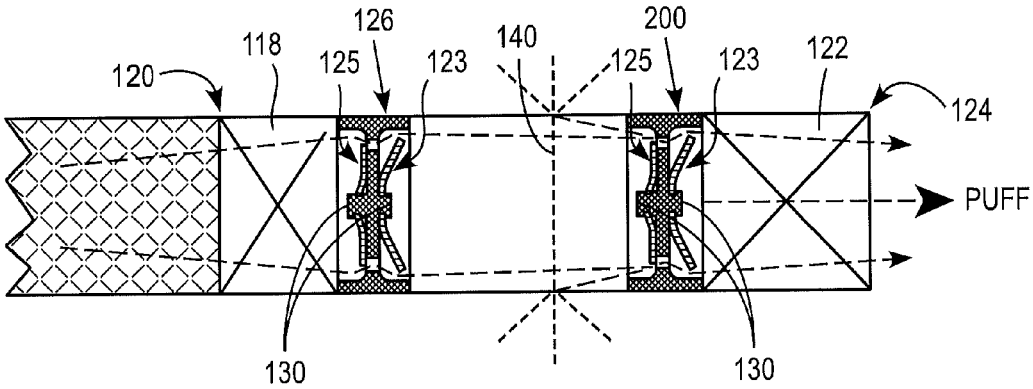
FIG. 4B is an illustration of the valved flow restriction device of 4A during a puff.

Referring now to FIG. 4A, in an embodiment, the filter includes an upstream flow restriction segment 126 and a second flow restriction segment 200 downstream of the upstream flow restriction segment 126. Preferably, the second flow restriction segment 200 is downstream of the ventilation zone 140 so as to isolate activated carbon and/or filter flavor systems from the tobacco rod and other filter components when the cigarette is not being smoked. During smoking, as seen in FIG. 4B, the upstream valves 125 and downstream valves 123 are deformed to allow smoke and flavor to pass through the orifice 130.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

We claim:

1. A smoking article comprising:

a tobacco rod adapted to produce mainstream smoke;

a filter attached to the tobacco rod by tipping paper, the filter having an upstream end adjacent the tobacco rod, a mouthpiece filter plug of low filtration efficiency cellulose acetate at a downstream end thereof, a restrictor defining at least one flow passage therethrough, an empty cavity located between the mouthpiece filter plug and the restrictor, a ventilation zone extending through the tipping paper and communicating with the cavity, and a valve which moves from a first position at which mainstream smoke freely passes through the at least on orifice in the restrictor to a second position at which the valve partially or fully closes the at least one orifice in the restrictor, the valve being effective to slow or stop flow of mainstream smoke through the restrictor at elevated draw pressures and allow free flow of mainstream smoke through the restrictor at lower draw pressures, wherein the valve comprises a first flap located upstream of an inlet of the at least one orifice in the restrictor, the first flap being movable at high draw pressure so as to partially or fully close the inlet of the at least one orifice in the restrictor, the valve including a second flap downstream of an outlet of the at least one orifice in the restrictor, the second flap being movable from a position closing the outlet to a position opening the outlet during a puff on the smoking article.

2. The smoking article of claim 1, wherein the cavity is defined by an inner periphery of a tubular segment.

3. The smoking article of claim 2, wherein said tubular segment is selected from the group consisting of a cellulosic tube, a hollow acetate tube, carbon on tow, carbon paper, and combinations thereof.

4. The smoking article of claim 1, wherein said filter and tobacco rod are attached with tipping paper, said ventilation zone including a row of perforations through the tipping paper.

5. The smoking article of claim 1, wherein the restrictor provides a predetermined resistance-to-draw of said smoking article of approximately 40 millimeters water or above.

6. The smoking article of claim 1, wherein the restrictor is formed from a material selected from high density polyethylene, polypropylene, nylon, compressed cellulosic material, and/or combinations thereof.

7. The smoking article of claim 1, wherein the restrictor is at least partially surrounded by cellulosic tubing, carbon paper, cellulose acetate, and/or carbon on tow.

8. The smoking article of claim 1, further comprising a sorbent containing filter segment upstream of the restrictor.

9. A smoking article comprising:

a tobacco rod adapted to produce mainstream smoke;

a filter attached to the tobacco rod by tipping paper, the filter having an upstream end adjacent the tobacco rod, a mouthpiece filter plug of low filtration efficiency cellulose acetate at a downstream end thereof, a restrictor defining at least one flow passage therethrough, an empty cavity located between the mouthpiece filter plug and the restrictor, a ventilation zone extending through the tipping paper and communicating with the cavity, a valve which moves from a first position at which mainstream smoke freely passes through the at least on orifice in the restrictor to a second position at which the valve partially or fully closes the at least one orifice in the restrictor, the valve being effective to slow or stop flow of mainstream smoke through the restrictor at elevated draw pressures and allow free flow of mainstream smoke through the restrictor at lower draw pressures, and a valved restrictor downstream of the cavity.

10. The smoking article of claim 8, further comprising a flavor bearing segment downstream of the restrictor, a sorbent bearing segment upstream of the restrictor, and the valve being effective to isolate the flavor bearing segment from the sorbent bearing segment during storage of the smoking article.

11. A smoking article comprising:

a tobacco rod adapted to produce mainstream smoke;

a filter operative with the tobacco rod, the filter comprising:

an upstream end adjacent the tobacco rod;

a mouthpiece filter plug at a downstream end thereof;

a cavity between said mouthpiece filter plug and said tobacco rod;

a restrictor adjacent said cavity, said restrictor defining at least one flow passage therethrough;

a ventilation zone at a location along said filter; and a valve which moves from a first position at which mainstream smoke freely passes through the at least one orifice in the restrictor to a second position at which the valve partially or fully closes the at least one orifice in the restrictor, the valve being effective to slow or stop flow of mainstream smoke through the restrictor at elevated draw pressures and allow free flow of mainstream smoke through the restrictor at lower draw pressures;

wherein the valve comprises a first moveable valve element located upstream of an inlet of the at least one orifice in the restrictor, the first moveable valve element being movable at high draw pressure so as to partially or fully close the inlet of the at least one orifice in the restrictor, the valve including a second moveable valve element downstream of an outlet of the at least one orifice in the restrictor, the second moveable valve element being movable from a position closing the outlet to a position opening the outlet during a puff on the smoking article.

* * * * *